US007707659B2

(12) United States Patent
Africa et al.

(10) Patent No.: US 7,707,659 B2
(45) Date of Patent: May 4, 2010

(54) CHAMOIS FOR ATHLETIC SHORTS HAVING RELATIVELY ELASTIC PORTION AND RELATIVELY INELASTIC PORTION

(75) Inventors: Robert Africa, Boulder, CO (US); Dylan Nelson, Boulder, CO (US)

(73) Assignee: DashAmerica, Inc., Louisville, CO (US)

( * ) Notice: Subject to any disclaimer, the term of this patent is extended or adjusted under 35 U.S.C. 154(b) by 283 days.

(21) Appl. No.: 10/711,710

(22) Filed: Sep. 30, 2004

(65) Prior Publication Data

US 2006/0048282 A1 Mar. 9, 2006

Related U.S. Application Data

(60) Provisional application No. 60/604,175, filed on Aug. 23, 2004.

(51) Int. Cl.
*A41D 27/26* (2006.01)
*A41D 1/08* (2006.01)

(52) U.S. Cl. ..... 2/267; 2/228

(58) Field of Classification Search ..... 2/228, 2/227, 69, 466, 267
See application file for complete search history.

(56) References Cited

U.S. PATENT DOCUMENTS 549,048 A 10/1895 Basch
585,210 A 6/1897 Isaacs
723,348 A 3/1903 Wilkens
1,711,611 A 5/1929 Mock
2,318,199 A 5/1943 Clements
2,465,136 A 3/1949 Troccoli
3,170,832 A 2/1965 Wilson et al.
3,354,020 A 11/1967 Copeland
3,504,387 A 4/1970 Hummel
3,597,765 A 8/1971 Stanton
3,909,847 A * 10/1975 Holt et al. ..... 2/465
3,954,537 A 5/1976 Alfter et al.
4,034,137 A 7/1977 Hofer
4,035,844 A 7/1977 Atack et al.
4,038,787 A 8/1977 Bianchi
4,055,699 A 10/1977 Hsiung
4,128,902 A 12/1978 Siebert
4,236,257 A 12/1980 Williams et al.
4,270,228 A 6/1981 Gaiser
4,326,003 A 4/1982 Bouhaniche
4,329,741 A 5/1982 Bach
4,370,754 A 2/1983 Donzis (Continued)

FOREIGN PATENT DOCUMENTS

DE 7723764 U 11/1977

(Continued)

OTHER PUBLICATIONS

Adidas Cycling, Spring Summer 99, product info-Adidas Padding Technology, p. 39.
The Summer Collection Brinko 99, M.C.S. Monocoque Confort Sit.
De Marchi, 1993 Estate Summer Collection "Soft Gel".
De Marchi Summer 1994 Cycling & ATB Wear, "Soft Gel".
De Marchi Winter 2001-2002 "Innovative Chamois" .
De Marchi Spring Summer 1999 PRO bib shorts'.

(Continued)

*Primary Examiner*—Alissa L Hoey
(74) *Attorney, Agent, or Firm*—Sheridan Ross, P.C.

(57) ABSTRACT

The present invention provides a chamois for use with athletic shorts and/or pants. The chamois comprises an elastic portion that stretches to conform to a wearer's body to reduce irritation and a relatively inelastic portion that resists stretch to inhibit breakdown of the foam in support areas.

18 Claims, 4 Drawing Sheets

U.S. PATENT DOCUMENTS

| | | | | |
|---|---|---|---|---|
| 4,397,636 | A | | 8/1983 | Ganshaw |
| 4,441,211 | A | | 4/1984 | Donzis |
| 4,485,568 | A | | 12/1984 | Landi et al. |
| 4,559,646 | A | | 12/1985 | Ertl |
| 4,625,350 | A | | 12/1986 | Urai et al. |
| 4,691,387 | A | | 9/1987 | Lopez |
| 4,788,972 | A | | 12/1988 | DeBusk |
| 4,805,243 | A | | 2/1989 | Gibbens et al. |
| 4,807,301 | A | | 2/1989 | Ferber |
| 4,894,867 | A | | 1/1990 | Ceravolo et al. |
| 4,920,577 | A | * | 5/1990 | Scharf ..... 2/24 |
| 4,926,503 | A | | 5/1990 | Wingo, Jr. |
| 4,945,571 | A | | 8/1990 | Calvert |
| 4,961,233 | A | * | 10/1990 | Black ..... 2/228 |
| 4,969,216 | A | | 11/1990 | Guelli |
| 5,031,640 | A | | 7/1991 | Spitzer |
| 5,038,408 | A | * | 8/1991 | DeBaene ..... 2/23 |
| 5,093,931 | A | | 3/1992 | LaBerge et al. |
| 5,103,505 | A | | 4/1992 | Liorens |
| 5,134,726 | A | | 8/1992 | Ross |
| 5,134,790 | A | | 8/1992 | Woitschaetzke et al. |
| 5,168,576 | A | | 12/1992 | Krent et al. |
| 5,210,877 | A | | 5/1993 | Newman |
| 5,271,101 | A | * | 12/1993 | Speth et al. ..... 2/228 |
| 5,274,846 | A | | 1/1994 | Kolsky |
| RE34,573 | E | | 4/1994 | Calvert |
| 5,345,609 | A | | 9/1994 | Fabry et al. |
| 5,365,610 | A | | 11/1994 | Lubahn et al. |
| 5,388,271 | A | | 2/1995 | Sessoms |
| 5,390,372 | A | | 2/1995 | Hashimoto et al. |
| 5,414,870 | A | | 5/1995 | Moretz et al. |
| 5,423,087 | A | | 6/1995 | Krent et al. |
| D360,971 | S | | 8/1995 | Speth et al. |
| 5,538,581 | A | | 7/1996 | Gallant |
| 5,539,926 | A | | 7/1996 | Mantos |
| 5,551,082 | A | | 9/1996 | Stewart et al. |
| 5,572,737 | A | | 11/1996 | Valice |
| 5,581,809 | A | | 12/1996 | Mah |
| 5,598,582 | A | | 2/1997 | Andrews et al. |
| 5,625,895 | A | | 5/1997 | Sovereign |
| 5,649,328 | A | | 7/1997 | Martin |
| 5,682,613 | A | | 11/1997 | Dinatale |
| 5,706,523 | A | | 1/1998 | Witzel |
| 5,749,111 | A | | 5/1998 | Pearce |
| 5,790,980 | A | | 8/1998 | Yewer, Jr. |
| 5,819,312 | A | | 10/1998 | Snyder et al. |
| 5,819,323 | A | * | 10/1998 | Edenfield ..... 2/466 |
| 5,820,445 | A | * | 10/1998 | Smith et al. ..... 450/86 |
| 5,842,232 | A | | 12/1998 | Parrish |
| 5,896,580 | A | * | 4/1999 | Aldrich et al. ..... 2/24 |
| 5,920,902 | A | * | 7/1999 | Crampton ..... 2/24 |
| 5,926,847 | A | | 7/1999 | Eibert |
| 5,978,970 | A | | 11/1999 | Bright |
| 5,987,642 | A | | 11/1999 | Webster |
| 5,994,450 | A | | 11/1999 | Pearce |
| 6,006,751 | A | | 12/1999 | Spitzer |
| 6,009,565 | A | | 1/2000 | Carrington |
| 6,023,789 | A | * | 2/2000 | Wilson et al. ..... 2/228 |
| 6,026,527 | A | | 2/2000 | Pearce |
| 6,032,300 | A | | 3/2000 | Bainbridge et al. |
| 6,070,273 | A | | 6/2000 | Sgro |
| 6,093,468 | A | | 7/2000 | Toms et al. |
| 6,154,885 | A | | 12/2000 | Kobayashi et al. |
| 6,171,431 | B1 | | 1/2001 | Gallagher, Jr. et al. |
| 6,182,297 | B1 | | 2/2001 | Duren et al. |
| 6,216,276 | B1 | | 4/2001 | Eibert |
| 6,273,777 | B1 | * | 8/2001 | Harris ..... 446/28 |
| 6,295,654 | B1 | | 10/2001 | Farrell |
| D452,764 | S | | 1/2002 | Garneau |
| D453,061 | S | | 1/2002 | Garneau |
| 6,345,396 | B1 | | 2/2002 | Schuler |
| 6,347,413 | B1 | * | 2/2002 | Sciscente et al. ..... 2/465 |
| RE37,705 | E | | 5/2002 | Donzis |
| 6,393,618 | B2 | | 5/2002 | Garneau |
| 6,408,446 | B1 | | 6/2002 | Carrington |
| 6,413,458 | B1 | | 7/2002 | Pearce |
| 6,425,135 | B1 | * | 7/2002 | Aldrich ..... 2/23 |
| 6,453,477 | B1 | | 9/2002 | Bainbridge et al. |
| 6,460,186 | B1 | | 10/2002 | Dailly |
| 6,519,781 | B1 | | 2/2003 | Berns |
| 6,532,599 | B1 | | 3/2003 | Dugan |
| 6,553,573 | B1 | | 4/2003 | Brown |
| 6,565,702 | B1 | * | 5/2003 | Forsyth et al. ..... 156/308.4 |
| 6,618,860 | B1 | | 9/2003 | Sullivan et al. |
| 6,655,048 | B2 | | 12/2003 | Moretti |
| 6,687,917 | B2 | * | 2/2004 | Forsyth et al. ..... 2/228 |
| 6,745,398 | B1 | * | 6/2004 | Hennessey ..... 2/23 |
| 6,797,765 | B2 | | 9/2004 | Pearce |
| 6,817,037 | B1 | | 11/2004 | King |
| 6,832,391 | B1 | | 12/2004 | Bower |
| 6,845,519 | B2 | | 1/2005 | Garneau |
| 6,918,140 | B1 | * | 7/2005 | Cooper ..... 2/228 |
| 6,928,665 | B1 | * | 8/2005 | Yates ..... 2/466 |
| 6,990,693 | B2 | * | 1/2006 | Reschewitz ..... 2/228 |
| 2002/0029409 | A1 | | 3/2002 | Coccia |
| 2003/0056282 | A1 | * | 3/2003 | Coccia ..... 2/466 |
| 2003/0167557 | A1 | | 9/2003 | LaShoto et al. |
| 2005/0066423 | A1 | * | 3/2005 | Hogan ..... 2/227 |
| 2005/0210570 | A1 | * | 9/2005 | Garneau ..... 2/466 |
| 2005/0223478 | A1 | * | 10/2005 | Hogan ..... 2/466 |
| 2006/0195968 | A1 | | 9/2006 | Powell et al. |
| 2007/0289047 | A1 | * | 12/2007 | Fortner ..... 2/268 |

FOREIGN PATENT DOCUMENTS

| | | |
|---|---|---|
| DE | 8905746 U1 | 8/1989 |
| EP | 0 643 929 A1 | 3/1995 |
| EP | 0776615 | 6/1997 |
| FR | 2476987 | 5/1986 |
| GB | 976890 | 12/1964 |
| IT | 059379 | 6/1995 |

OTHER PUBLICATIONS

Scheller's Fitness & Cycling Your Fitness Pros "All About Lycra Bicycle Shorts, The Basic Bike Shorts: Essential and Amazing!" 4 pages.

Aero Tech Design Cyclewear "Women's Pro Bike Shorts $25.95" 2 pages.

Santini Cycling Shorts w/ll Top Chamois Highly Pro 2 pages.

Written Opinion for International (PCT) Application PCT/US05/20867, mailed Sep. 22, 2006.

International Preliminary Report on Patentability for International (PCT) Application No. PCT/US05/20867, completed Mar. 19, 2007.

International Search Report for International (PCT) Application No. PCT/US2002/032985, mailed May 6, 2003.

Supplementary European Search Report for European Application No. 02778578, dated May 21, 2007.

Official Action for European Application No. 02778578, dated Sep. 30, 2008.

Official Action for European Application No. 02778578, dated Jun. 9, 2004.

International Search Report mailed Sep. 22, 2006, PCT/US05/20867 (WO 2006/023007), 6 pages.

Restriction Requirement mailed Nov. 8, 2002, U.S. Appl. No. 10/012,922, 5 pages.

Reply to Restriction Requirement dated Nov. 25, 2002, U.S. Appl. No. 10/012,922, 1 page.

Notice of Allowance and Fee(s) Due mailed Mar. 10, 2003, U.S. Appl. No. 10/012,922, 12 pages.

Notice of Allowance and Fee(s) Due mailed Dec. 3, 2003, U.S. Appl. No. 10/249,224, 6 pages.

* cited by examiner

CHAMOIS FOR ATHLETIC SHORTS HAVING RELATIVELY ELASTIC PORTION AND RELATIVELY INELASTIC PORTION

FIELD OF THE INVENTION

The present invention relates to chamois and, more particularly, to chamois having relatively higher elastic and relatively lower elastic or inelastic portions.

BACKGROUND OF THE INVENTION

Cycling pants/shorts of various configurations have become popular because they provide some cushioning between the bicycle seat and the cyclist, and they minimize chafing of the body of the cyclist. Cycling shorts conventionally include an inner pad, or chamois as they are known in the art, located in the crotch and buttocks regions of the cyclist. Shorts and pants are used interchangeably in this application. While some chamois are composed of a number of pieces of flexible material that are stitched together, other chamois are formed of one piece of material. As used in this application flexible generally means pliable or bendable.

One conventional chamois is described in U.S. Pat. No. 5,271,101, titled Cycling Shorts with Anatomical Seat Pad, issued Dec. 21, 1993, to Septh et al., incorporated herein by reference as if set out in full. The '101 patent provides cycling shorts having a padded, three-layer, seat liner having a plurality of integrally formed and embossed break lines.

While these early chamois provided some improvement and comfort, the early chamois, such as the '101 chamois, still caused irritation to the wearer. To reduce irritation, and provide increased comfort and durability, multiple density chamois were developed. Such multiple density chamois are described in U.S. Pat. No. 6,687,917, titled Chamois for Cycling Pants and Method of Making, issued Feb. 10, 2004, to Forsyth et al. and U.S. Pat. No. 6,565,702, titled the same, issued May 20, 2003, to Forsyth et al., both of which are incorporated herein by reference. The multiple density chamois provided increased support in the areas where increased support was necessary, and increased pliability where increased pliability was necessary. The multiple density chamois enhanced chamois performance, but still caused irritation to users.

Recently, a trend has begun where the chamois is constructed out of not just one or more density and/or thickness materials, but elastic materials as well. Elastic as used in this application generally means stretchable, unlike the use of the term flexible, which refers to pliable. Using elastic and flexible material allows the chamois to stretch and bend with the user's body tending to reduce irritation.

While using elastic material provided some benefits, the support material tends to breakdown after repeated stretch and retraction of the foam. Thus, it would be desirable to provide a chamois that corrected this and other problems with the prior art.

SUMMARY OF THE INVENTION

To attain the advantages and in accordance with the present invention, a chamois is provided. The chamois comprises a garment facing side and a body facing side. The chamois further comprises at least two materials, one material being a relatively elastic material and the second material being a relatively inelastic material.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

The present invention will now be explained with reference to FIGS. 1 to 5. While the present invention is explained with particular reference to chamois for cycling shorts, one of ordinary skill in the art will recognize on reading the disclosure that the present invention has multiple uses and multiple configurations. In particular, the present invention would be useful in any multi-density system where at least a portion of the system needs to be elastic.

Figure 1:
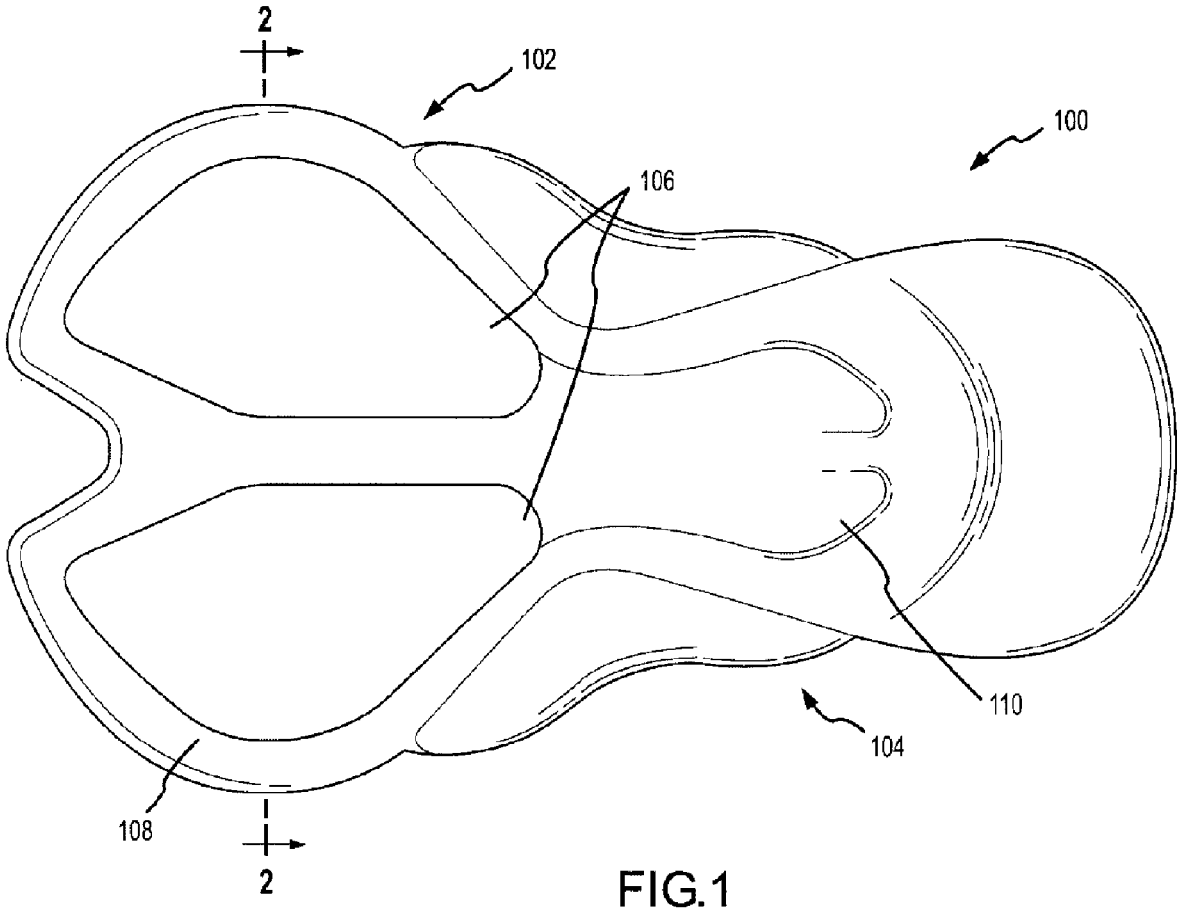
FIG. 1 is a body-side plan view of a chamois constructed in accordance with an embodiment of the present invention.

FIG. 1 illustrates a chamois 100 constructed in accordance with the present invention. Chamois 100 has a buttocks region 102 and an abdominal region 104. Buttocks region 102 has a plurality of buttocks support areas 106 defined by seams 108. Seams 108 may be embossed seams, welded seams, bonded seams, adhesive seals, stitched seams, or a combination thereof.

While chamois 100 is shown with two separate buttocks support areas 106, areas 106 could be connected into a single area 106 or each shown pad 106 could be split into multiple pad areas as a matter of design choice. Further, the overall shape of buttocks support areas 106 is a matter of design choice. Moreover, as shown in FIG. 1, chamois 100 may contain additional support areas, such as, for example, abdominal support area 110. More, less, or different support areas are possible as a matter of design choice.

Figure 2:
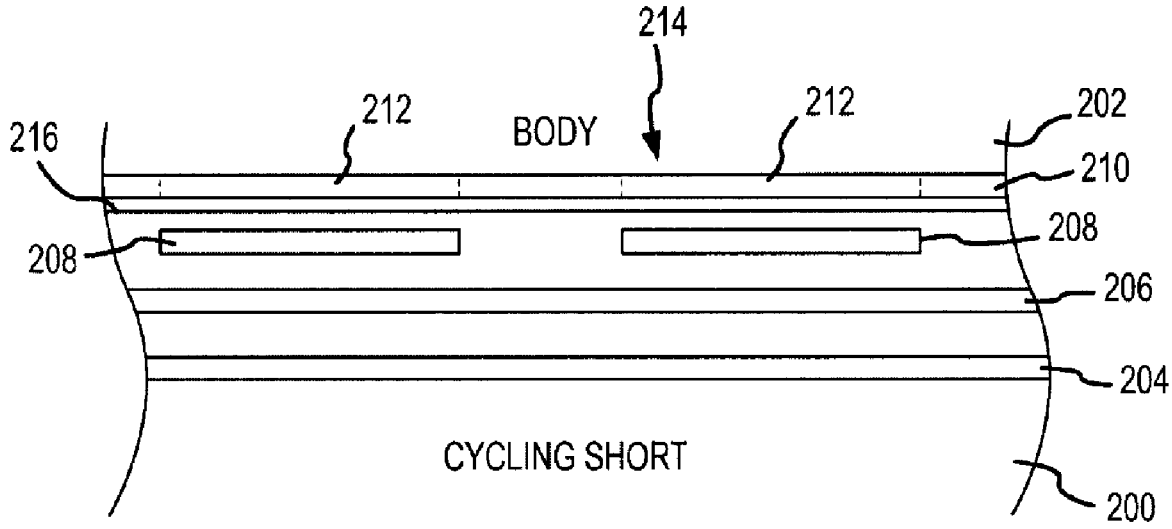
FIG. 2 is an exploded, cross-sectional view of the chamois of FIG. 1.

Referring now to FIG. 2, a cross-sectional view of chamois 100 about line 2-2 is shown. As shown, chamois 100 resides between a garment, such as cycling short 200 and a wearer, such as cyclist body 202. Chamois 100 comprises a garment facing elastic cloth layer 204 situated proximate the short 200. A relatively high elasticity foam layer 206 is provided on cloth layer 204 and generally traverses the entire chamois 100 although elastic foam layer 206 does not need to be contiguous. Elastic foam layer 206 may be comprised of a number of elastic or stretchable foams such as, for example, high density closed cell foam, low density open cell foam, combinations thereof, or the like. A plurality of foam pads 208 are arranged on elastic foam layer 206. Foam pads 208 comprise a relatively low elastic foam or an inelastic foam, such as, for example, high density closed cell foam, low density open cell foam, combinations thereof, or the like. As used herein, relatively inelastic generally means less elasticity than the elastic materials, which includes inelastic materials. For example, the relatively elastic portions of the chamois may experience a stretch of about 5% with complete recovery using a 2-lb weight to stretch the material. A stretch of about 5% means about a 5% change in the dimension (length, width, diagonal, etc.) being tested. Other relatively elastic portions may experience stretch of about 2% to 25% or more depending on the specific materials used for construction. The relatively inelastic portions typically have stretch values of less than 1 or 2% and as close to zero stretch as possible, but can have stretch values of up to about 5% less than the stretch of the relatively elastic portion. However, for relatively elastic portions of the chamois being around 20%, the relatively inelastic portion of the chamois should be around 5% or less. Also, foam pads 208 may comprises single density foams, such as, for example, 60 kg open cell foam that are generally known in the art, or the like, or multi-density foams, such as, for example, 60 kg open cell foam and 120 kg closed cell foam that are generally known in the art, or the like. If support areas 106 and 110 comprise a single area, only one foam pad 208 would be provided.

Finally a body side elastic cloth layer 210 is provided proximate the body. Cloth layer 210 may comprise a wickable, absorbable, or hydrophobic material as a matter of design choice. Cloth layer 210 generally traverses all of chamois 100. Optionally, portions 212 of cloth layer 210 (off-set in phantom) may be replaced with relatively low elastic or inelastic material substantially aligned with foam pads 208. Non-stretchable synthetic leather provides one possible portion 212. Portions 212 could be contiguous with cloth layer 210. Alternatively, through holes 214 could be cut into cloth layer 210 and portions 212 could be arranged in through holes 214. Alternatively, portions 212 could reside on cloth layer 210 and be substantially aligned with foam pads 208.

Figure 2A:
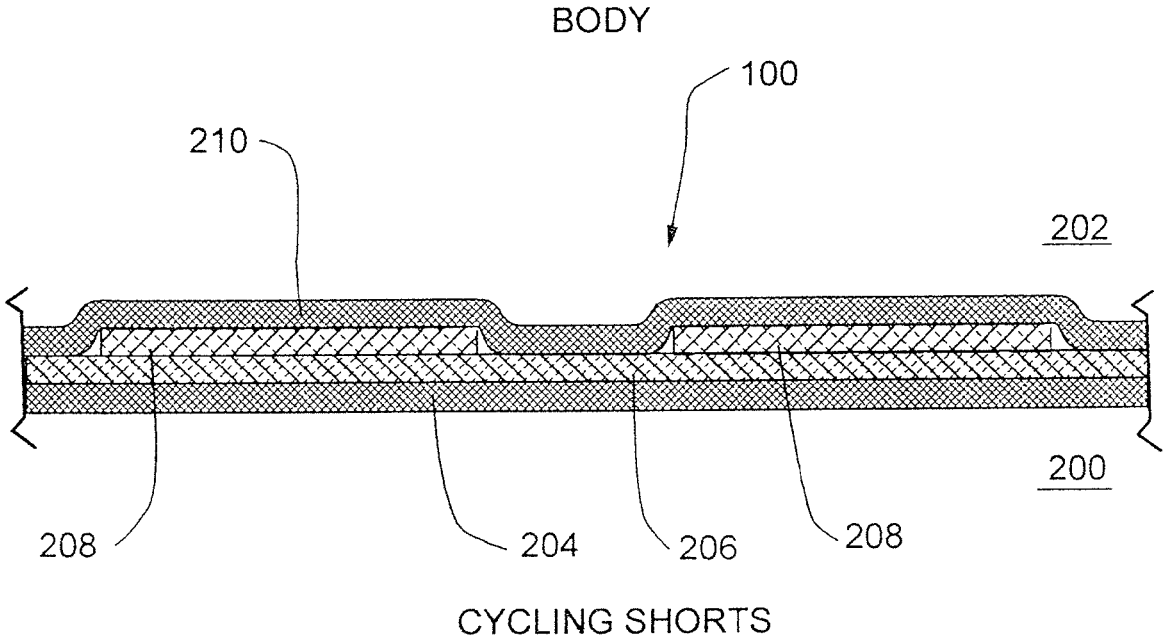
FIG. 2A is an assembled cross-section view of the chamois of FIG. 1, showing the chamois without the optional elastic anti-microbial material layer 216.

FIG. 2A depicts an assembled cross-section view of the chamois 100. With reference to FIGS. 2 and 2A, the cloth layers 204, 210, foam layer 206, and foam pads 208 each include a cycling short or garment facing side (i.e., a side that faces towards the garment) and a body facing (i.e., a side that faces towards the body). More particularly, as viewed in FIGS. 2 and 2A, the lower sides of the cloth layers 204, 210, foam layer 206, and foam pads 208 are the garment facing sides of these layers and pads, and their upper sides are the body facing sides of these layers and pads.

When the chamois 100 is assembled as shown for example in FIG. 2A, at least a portion of the body facing side of cloth layer 204 may contact or abut at least a portion of the garment facing side of the foam layer 206. Yet further, as described above, the foam layer 206 may generally traverse the entire chamois 100. Accordingly, in some embodiments, the garment facing side of the foam layer 206 may solely contact or abut the body facing side of cloth layer 204.

With continued reference to FIG. 2A, which shows one possible assembled condition for the chamois 100, at least a portion of the garment facing side of one or more of the foam pads 208 may contact or abut at least a portion the body facing side of the foam layer 206. Additionally, at least a portion of the body facing side of the foam layer 206 may abut or contact at least a portion of the garment facing side of cloth layer 210. Yet further, at least a portion of the body facing side of one or more of the foam pads may contact or abut at least a portion of the garment facing side of cloth layer 210.

As described above, foam layer 206 may generally traverse the entire chamois 100 , and the foam pads may generally be positioned in support areas 106 and 110. With reference to FIG. 1, support areas 106 and 110 may occupy a portion of the area encompassed by chamois 100. Further, the perimeter of chamois 100 may generally encompass each of these support areas 106 and 110, and thus may generally encompass the perimeters of one or more of the foam pads 108 positioned in these support areas 106 and 110. Since foam layer 206 may generally transverse the entire chamois 100, the perimeter of foam layer 206 may generally correspond to the perimeter of chamois 100. Accordingly, like the perimeter of the chamois 100, the perimeter of foam layer 206 may generally encompass the perimeters of one or more of the foam pads 108.

Optionally, cloth layer 210 may contain anti-microbial material. Anti-microbial material is generally known in the art and will not be further explained herein. Instead of incorporating an anti-microbial material into cloth layer 210, a separate elastic anti-microbial material layer 216 may be provided.

Support areas, such as, for example, buttocks support areas 106 and abdominal support areas 110 are typically designed to provide support for the wearer's body. Ideally, the additional support is provided by a relatively high density foam pad 208, a relatively thicker foam pad 208, or a combination of a relatively denser foam pad and relatively thicker foam pad 208, although foam pad 208 could be the same density and thickness as foam layer 206. Moreover, foam pads may contain multi-density foams as described above.

As mentioned above, repeated stretching and contracting of foams increase the fatigue and accelerate the breakdown of the foam. This tends to decrease the overall effectiveness of the support areas, such as, buttocks support areas 106 and abdominal support areas 110. Providing pads 208 as relatively low elasticity and or inelastic materials reduces the stresses the foam experiences and inhibits the breakdown of the material, which tends to enhance the overall performance. Alternatively, providing relatively inelastic seams 108 and/or relatively inelastic portions 212 reduces the stresses as well. Combining relatively inelastic pads along with inelastic seams 108 and/or inelastic portions 212 would also reduce the stress.

Figure 3:
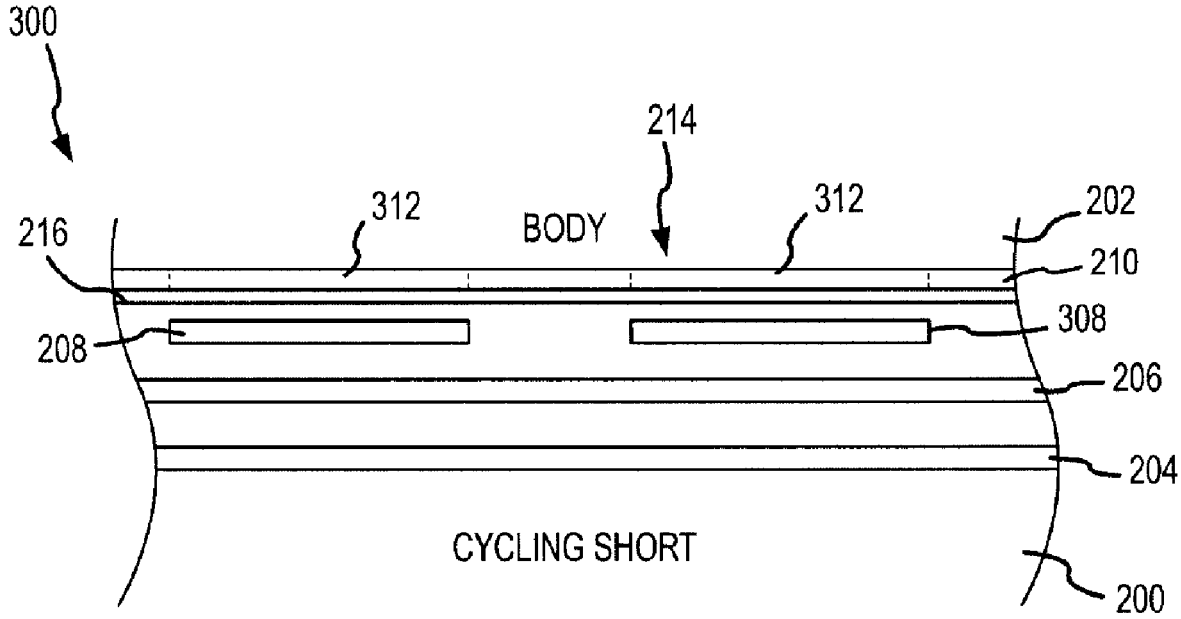
FIG. 3 is an exploded, cross-sectional view of an alternative chamois constructed in accordance with another embodiment of the present invention.

Referring to FIG. 3, a chamois 300 is shown. Chamois 300 is generally similar to chamois 100 above, and the similarities will not be re-explained herein. Chamois 300 has a plurality of foam pads 308 arranged on elastic foam layer 206. Foam pads 308 are substantially aligned with support areas, such as, for example, buttocks support area 106. Foam pads 308 may comprise either a relatively high or low elasticity foam, such as any of the foams mentioned above. In this case where foam pads 308 are elastic, layer 210 has portions 312 comprising a relatively low elasticity or inelastic material, such as, for example, synthetic leather, are arranged as relatively low elasticity or inelastic constraints on the ability of foam pad 308 to stretch.

Figure 4:
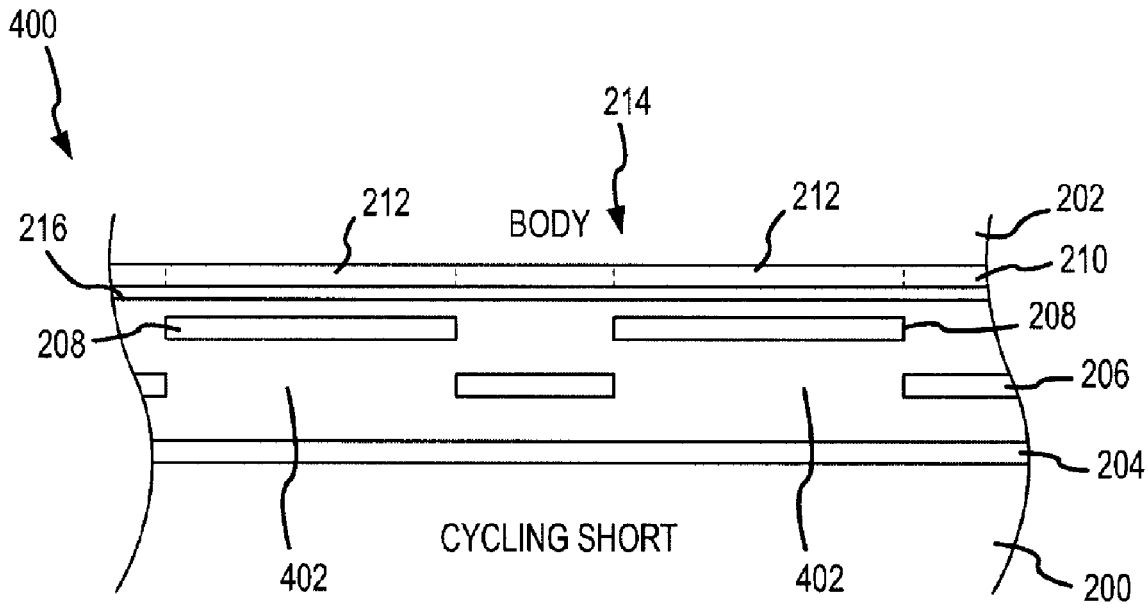
FIG. 4 is an exploded, cross-sectional view of an alternative chamois constructed in accordance with another embodiment of the present invention.

FIG. 4 shows another chamois 400 consistent with the present invention. Chamois 400 is similar to chamois 100 or 300, but elastic layer 206 contains a number of through holes 402 corresponding to the number of support areas, such as support areas 106. Foam pads 208 are aligned within through holes 402 instead of residing on elastic layer 206.

Figure 5:
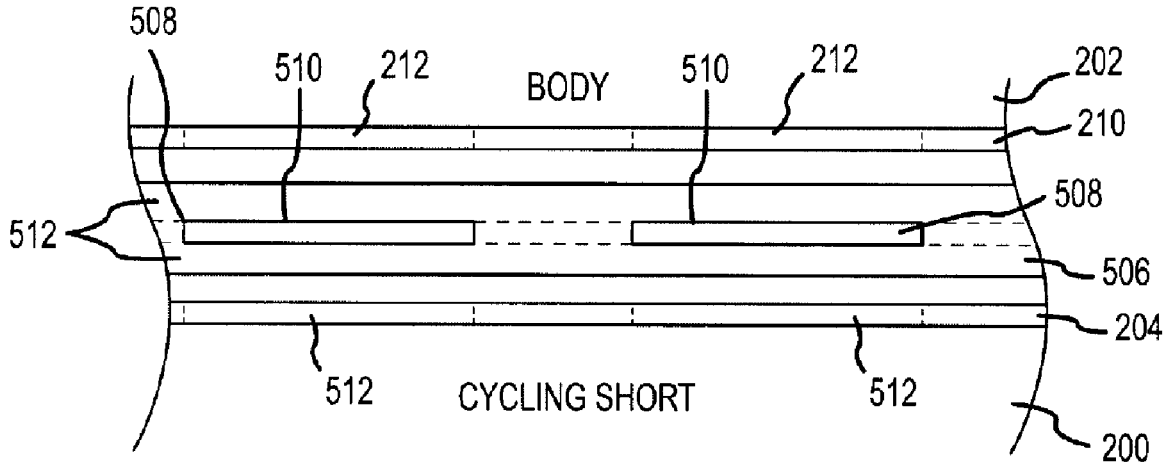
FIG. 5 is an exploded, cross-sectional view of an alternative chamois constructed in accordance with another embodiment of the present invention.

FIG. 5 shows another chamois 500. Chamois 500 is consistent with either chamois 100 or 300, and comprises cloth layers 204 and 210. Cloth layer 210 may have portions 212 designed with relatively low elasticity or inelastic material. Similarly, cloth layer 204 may have portions 512 (similar to portions 212 described above). Residing between cloth layers 204 and 210 is an elastic foam layer 506. Elastic foam layer 506 has a number of through openings 508 containing foam pads 510. Foam pads 510 comprise a relatively low elasticity or inelastic foam material and are substantially contained in foam layer 506.

Instead of openings 508, as shown in phantom in FIG. 5, elastic foam layer 506 could be replaced with two foam layers 512 arranged with foam pads 510 contained between the layers.

Finally, referring back to FIGS. 1 and 2, if cloth layer 210 did not include anti-stretch portions 212 and foam 208 was relatively high elasticity foam, constructing seams 108 out of a relatively low elasticity or inelastic material or construction could function to inhibit the stress on foams 208.

While the invention has been particularly shown and described with reference to embodiments thereof, it will be understood by those skilled in the art that various other changes in the form and details may be made without departing from the spirit and scope of the invention.

What is claimed is:

1. A multi-layer pad for bicycling shorts, comprising:
a first cloth layer;
the first cloth layer being elastic;
a second cloth layer;
the second cloth layer being elastic and having at least one inelastic portion;
a first continuous foam layer;
the first continuous foam layer coupled to the first cloth layer;
the first continuous foam layer located between the first cloth layer and the second cloth layer and contacting the first cloth layer and the second cloth layer;
the first continuous foam layer being elastic such that the multi-layer pad stretches;
at least one foam pad coupled to the first continuous foam layer wherein the at least one foam pad is aligned to support at least the buttocks area of a user;
the at least one foam pad positioned between the first continuous foam layer and the second cloth layer;
the first continuous foam layer interposed between the first cloth layer and the at least one foam pad to prevent contact between the at least one foam pad and the first cloth layer; and
the at least one foam pad aligned with the at least one inelastic portion of the second cloth layer, such that the at least one foam pad is inhibited from stretching.

2. The multi-layer pad of claim 1, wherein the at least one foam pad is inelastic.

3. The multi-layer pad of claim 2, wherein the at least one foam pad is denser than the first continuous foam layer.

4. The multi-layer pad of claim 2, wherein the at least one foam pad comprises multiple densities at least one of which is denser than the first continuous foam layer.

5. The multi-layer pad of claim 1, wherein the at least one foam pad is elastic.

6. The multi-layer pad of claim 1, wherein at least the second cloth layer contains an anti-microbial material.

7. The multi-layer pad of claim 1, wherein the first cloth layer comprises an inelastic portion aligned with the at least one foam pad.

8. The multi-layer pad of claim 1, wherein the multi-layer pad is flexible.

9. The multi-layer pad of claim 1, further comprising the first continuous foam layer coupled to the second cloth layer.

10. A multi-layer pad for cycling shorts configured to support at least the buttocks area of a user, comprising:
first and second elastic cloth layers, wherein the second elastic cloth layer has at least one inelastic portion;
a continuous foam layer positioned between and in contact with the first and the second elastic cloth layers, wherein the continuous foam layer is coupled to the first and the second elastic cloth layers;
at least one foam pad positioned between the continuous foam layer and the second elastic cloth layer, wherein the at least one foam pad is coupled to the continuous foam layer, wherein the continuous foam layer is interposed between the at least one foam pad and the elastic cloth layer to prevent the at least one foam pad from contacting the first elastic cloth layer and wherein the at least one foam pad is aligned with the at least one inelastic portion to inhibit the at least one foam pad from stretching and wherein the at least one foam pad is aligned to support at least the buttocks area of a user.

11. The multi-layer pad of claim 10, wherein at least one of the following is true:
i) the at least one foam pad is elastic;
ii) the at least one foam pad is inelastic;
iii) the at least one foam pad is denser than the first continuous foam layer; and
iv) the at least one foam pad comprises multiple densities, wherein at least one of the multiple densities is denser than the first continuous foam layer.

12. The multi-layer pad of claim 10, wherein the multi-layer pad is flexible.

13. The multi-layer pad of claim 10, wherein at least the second elastic cloth layer contains an anti-microbial material.

14. The multi-layer pad of claim 10, wherein the first elastic cloth layer comprises at least one inelastic portion aligned with the at least one foam pad.

15. A multi-layer pad for cycling shorts configured to support at least the buttocks area of a user, comprising:
first and second elastic cloth layers, wherein the second elastic cloth layer has at least one inelastic portion;
a continuous foam layer positioned between and in contact with the first and the second elastic cloth layers, wherein the continuous foam layer is coupled to the first and the second elastic cloth layers;
at least one foam pad positioned between the continuous foam layer and the second elastic cloth layer, wherein the at least one foam pad is:
a) coupled to the continuous foam layer,
b) aligned with the at least one inelastic portion to inhibit the at least one foam pad from stretching,
c) prevented from contacting the first cloth layer by the interposition of the continuous foam layer between the first elastic cloth layer and the at least one foam pad,
d) one of an inelastic or elastic material,
e) denser than the first continuous foam layer, and
f) aligned to support at least the buttocks area of a user.

16. The multi-layer pad of claim 15, wherein the first cloth layer comprises at least one inelastic portion aligned with the at least one foam pad.

17. The multi-layer pad of claim 15, where the multi-layer pad is flexible and wherein at least the second cloth layer contains an anti-microbial material.

18. The multi-layer pad of claim 15, wherein the foam pad comprises multiple densities and wherein at least one of the multiple densities is denser than the first continuous foam layer.

* * * * *